US005996555A

United States Patent [19]

Lafontaine

[11] Patent Number: 5,996,555

[45] Date of Patent: Dec. 7, 1999

[54] ELECTRONIC IGNITION SYSTEM FOR AN INTERNAL COMBUSTION ENGINE

[75] Inventor: Yvan Lafontaine, Grand-Mère, Canada

[73] Assignee: Megatech Electro Inc., Grand-Mère, Canada

[21] Appl. No.: 09/094,717

[22] Filed: Jun. 18, 1998

[51] Int. Cl.[6] ..... F02P 5/15; F02P 7/06

[52] U.S. Cl. ..... 123/406.58; 123/41 E

[58] Field of Search ..... 123/41 R, 41 E, 123/406.58, 406.61, 612–617

[56] References Cited

U.S. PATENT DOCUMENTS 3,189,009 6/1965 Andersen ..... 123/41 E

FOREIGN PATENT DOCUMENTS 2179351 12/1996 Canada .

*Primary Examiner*—Tony M. Argenbright

*Attorney, Agent, or Firm*—Goudreau Gage Dubue & Martineau Walker

[57] ABSTRACT

An electronic ignition system for an internal combustion engine is described herein. The ignition system includes a sensor assembly provided with two sensing elements configured and sized to detect teeth mounted on an outer cylindrical surface of the rotor of the voltage generator and to supply trigger signals to a controller. For each piston of the combustion engine, two teeth are provided onto the rotor. A first tooth is positioned to be detected before the piston reaches its top dead center when the rotor rotates in a forward direction and a second tooth is positioned to be detected before the piston reaches its top dead center when the rotor rotates in a reverse direction.

7 Claims, 2 Drawing Sheets

ELECTRONIC IGNITION SYSTEM FOR AN INTERNAL COMBUSTION ENGINE

FIELD OF THE INVENTION

The present invention relates to electronic ignition systems. More specifically, the present invention is concerned with an electronic ignition system for internal combustion engines.

BACKGROUND OF THE INVENTION

Two-stroke internal combustion engines have a structure which does not vary substantially with respect to the rotational direction of the engine. The direction of rotation of the engine is largely dictated by the ignition timing signals which must be suitably advanced with respect to the top dead center of the cylinders of the engine.

In some applications of two-stroke internal combustion engines, it is advantageous to enable the operation of the engine in both rotation directions, for example in order to reverse the travel direction of a vehicle.

Of course, it is possible to circumvent this problem by providing a mechanical solution, for example, by mounting a gearbox downstream from the engine's rotatable shaft to determine the direction of travel. This way, the direction of rotation of the combustion engine does not change.

The drawbacks with these mechanical solutions regard the cost and the weight increases caused by the supplementary gearbox.

An electronic solution has also been proposed to allow the direction of rotation of two-stroke internal combustion engines to be reversed. Generally stated, the electronic solution concerns the management of the ignition procedure to cause the reversal of the rotation direction by means of suitable control signals picked up from the voltage generated by the same voltage generator which is powering the electronic ignition system of the engine.

An example of an electronic ignition system allowing the reversal of the rotation direction of a two-stroke internal combustion engine may be found in Canadian Patent Application No. 2,179,351 published on Dec. 22, 1996 and naming Venturoli et al. as inventors. This system uses two angularly spaced signal pickup devices to detect teeth provided on the rotor of the voltage generator. The signals generated by these devices are supplied to a microprocessor. Since the two pickup devices detect the same tooth when the rotor is at different angular positions, the rotation direction of the engine may be deduced by the microprocessor and the signals supplied by the two pickup devices may be used to control the ignition of the engine to keep the direction of rotation or to reverse this direction.

A drawback with the system described by Venturoli et al. is that two signal pickup devices must be provided in the combustion engine and that these two devices must be angularly spaced from one another.

OBJECTS OF THE INVENTION

An object of the present invention is therefore to provide an improved electronic ignition system for two-stroke internal combustion engines.

Another object of the present invention is to provide an electronic ignition system using one sensor assembly.

SUMMARY OF THE INVENTION

More specifically, in accordance with the present invention, there is provided an electronic ignition system for an internal combustion engine including at least one cylinder in which a respective piston is slidably mounted for reciprocate movements between a top dead center and a bottom dead center; the piston being coupled to a rotor of the internal combustion engine; the rotor having a rotation axis and a generally cylindrical outer surface coaxial with the rotation axis; the outer surface of the rotor defining a rear cylindrical surface portion and a front cylindrical surface portion; the electronic ignition system comprising:

a controller;

for each piston, a first tooth mounted to a first predetermined position onto the rear cylindrical surface portion;

for each piston, a second tooth mounted to a second predetermined position onto the front cylindrical surface portion;

a sensor assembly including first and second sensing elements connected to the controller; the first sensing element facing the rear cylindrical surface portion of the rotor and supply a first trigger signal to the controller upon detection of the first projection; the second sensing element facing the front cylindrical surface portion of the rotor and supply a second trigger signal to the controller upon detection of the second projection;

wherein (a) the first predetermined position of the first tooth is such that the first sensing element supplies the first trigger signal to the controller before the piston reaches its top dead center when the rotor rotates about the rotation axis in a first direction; and (b) the second predetermined position of the second tooth is such that the second sensing element supplies the second trigger signal to the controller before the piston reaches its top dead center when the rotor rotates about the rotation axis in a second direction opposite to the first direction.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Figure 1:
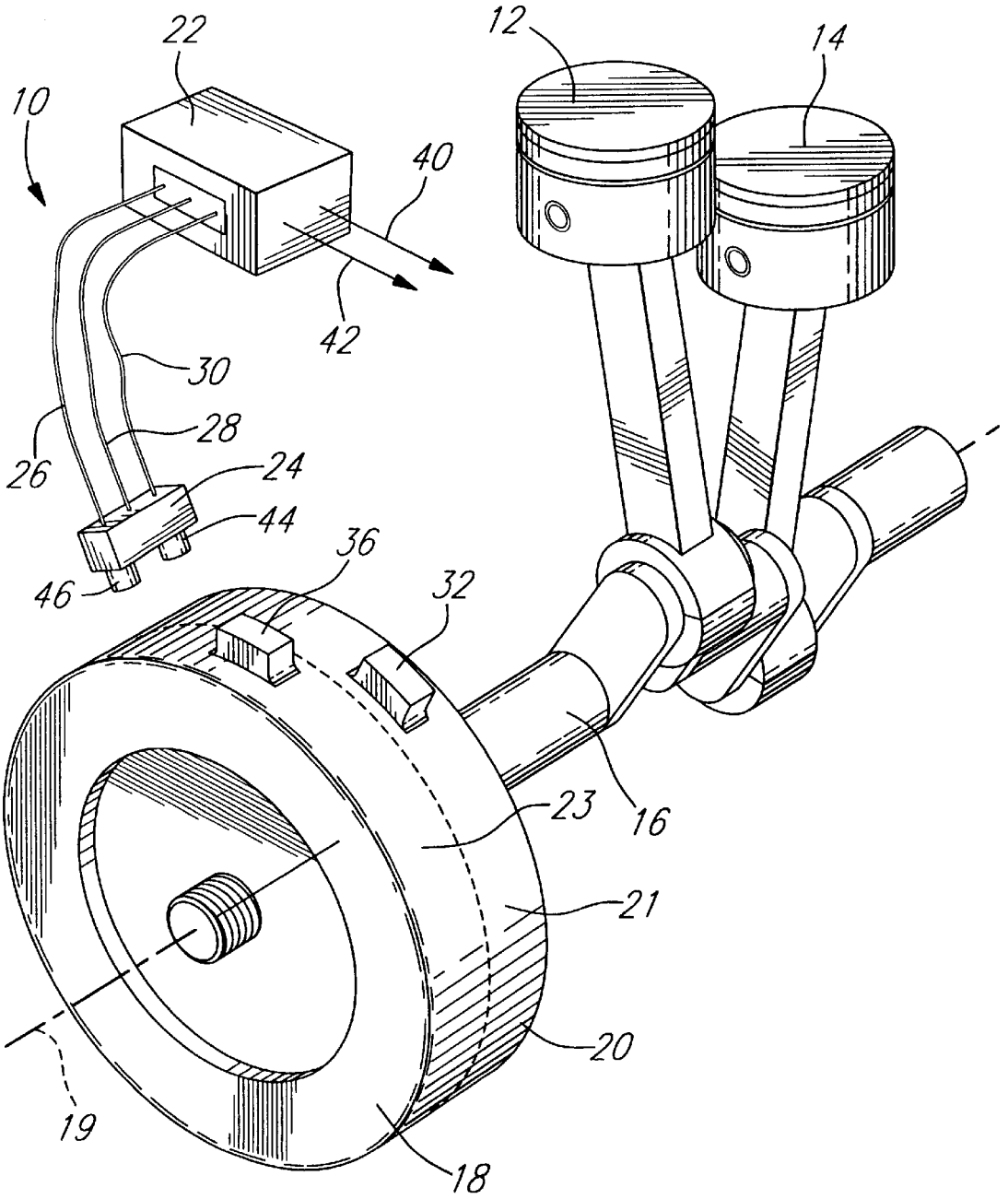
FIG. 1 is a schematic perspective view illustrating an electronic ignition system according to an embodiment of the present invention.

FIG. 1 of the appended drawings illustrates an electronic ignition system 10, for an internal combustion engine, according to a preferred embodiment of the present invention.

The ignition system 10 is connected to a pair of pistons 12, 14 via a crank shaft 16 in a conventional manner. The crank shaft 16 is connected to a voltage generator provided with a rotor 18 having a cylindrical outer surface 20. The rotor 18 may therefore rotate about a rotation axis 19.

The ignition system 10 includes a controller circuit 22, a sensor assembly 24 electrically connected to the controller 22 via electrical wires 26, 28 and 30, and first and second pairs of teeth 32, 34 and 36, 38 (FIGS. 2 and 3) mounted at predetermined axial positions onto the outer cylindrical surface 20 of the rotor 18, as will be described hereinafter.

As will be easily understood by one skilled in the art, the voltage generator also includes a main winding (not shown) used to power the ignition system 10. It is also to be noted that the controller 22 includes an electronic circuit and other electrical components (not shown) conventionally used to selectively supply an adequate spark generating voltage to spark plugs (not shown) of the pistons 12 and 14 via electrical wires 40, 42.

As can be clearly seen from FIG. 1 of the appended drawings, the first pair of teeth is axially spaced from the second pair of teeth. More specifically, the first pair of teeth are provided in a rear portion 21 of the outer rotor surface 20 while the second pair of teeth are provided in a front portion 23 of the outer rotor surface 20. Furthermore, the teeth 32 and 36 are angularly spaced apart from one another. Similarly, as can be seen from FIGS. 2 and 3, teeth 34 and 38 are also angularly spaced apart from one another.

The sensor assembly 24 includes a first sensing element 44 axially aligned with the first pair of teeth 32, 34 and a second sensing element 46 axially aligned with the second pair of teeth 36, 38.

The sensing elements 44 and 46 are proximity sensing elements configured and designed to detect the leading edges of the teeth 32, 34 and 36, 38, respectively. For example, it has been found that variable resistance proximity sensing elements give satisfactory results. Of course, other types and/or models of sensing elements could be used such as, for example, Hall-effect sensing elements or magnetoresistive sensing elements.

Upon detection of leading edges, the sensor assembly 24 supplies trigger signals to the controller 22 via wires 26, 28 and 30. These trigger signals are used by the controller 22 to determine (a) the direction of rotation of the rotor 18 and (b) the timing of the spark generation voltage supplied to the spark plugs via the wires 40 and 42. Indeed, as will be easily understood by one skilled in the art the order in which the teeth are detected by the sensing elements 44 and 46 indicates the direction of rotation of the rotor 18. Also, since the angular relation between the position of the teeth onto the outer peripheral surface 20 of the rotor 18 and the top dead center of the pistons 12 and 14 is known, the controller 22 may determine the optimal timing to energize the spark plugs. Since the optimal timing considerations are known in the art and beyond the scope of the present application, they will not be further discussed herein.

Figure 2:
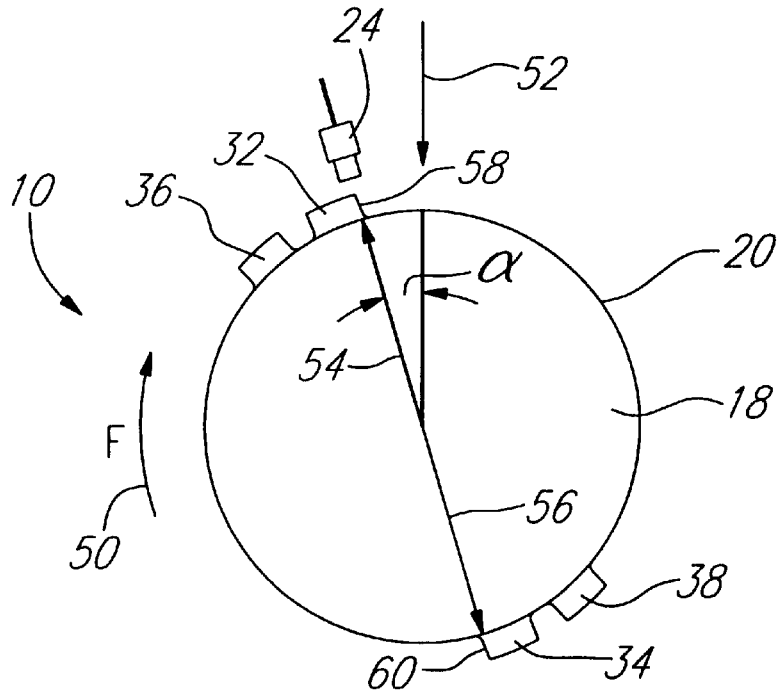
FIG. 2 is a schematic front elevational view of the rotor of FIG. 1, illustrating the detection of a tooth when the rotor rotates in a clockwise direction.
Figure 3:
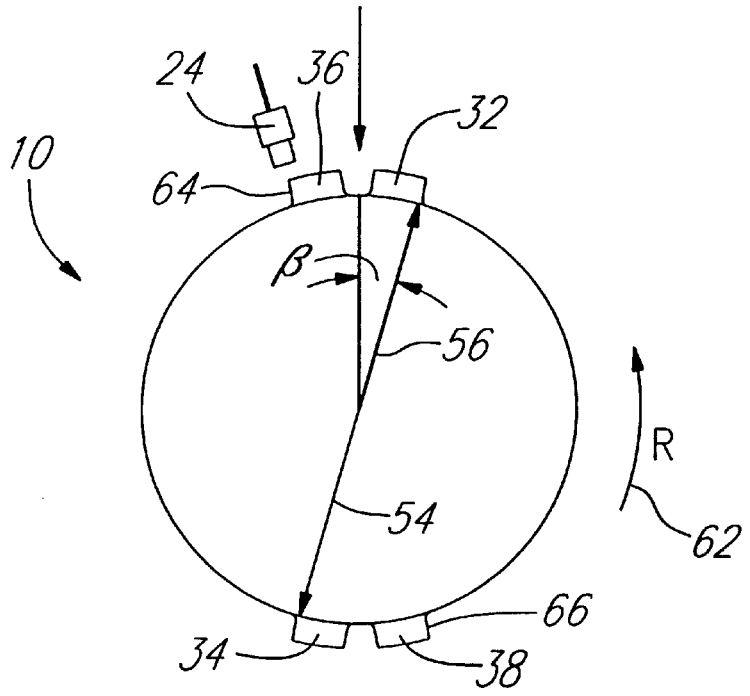
FIG. 3 is a schematic front elevational view of the rotor of FIG. 1, illustrating the detection of a tooth when the rotor rotates in a counterclockwise direction.

Turning now to FIGS. 2 and 3 of the appended drawings, a schematic angular representation of the teeth 32–38 with respect to the top dead centers of the piston 12 and 14 will be described.

FIG. 2 illustrates the rotor 18 when it rotates in a forward direction (see arrow 50). To illustrate the operation of the electronic ignition system 10, an external imaginary arrow 52 and first and second internal imaginary arrows 54, 56 are provided. The internal arrows 54 and 56 rotate with the rotor 18. When the internal arrow 54 is aligned with the external arrow 52, the piston 12 is in its top dead center position and the piston 14 is in its bottom dead center position. Conversely, when the internal arrow 56 is aligned with the external arrow 52, the piston 12 is in its bottom dead center position and the piston 14 is in its top dead center position.

In FIG. 2, the rotor 18 is positioned to illustrate detection of the leading edge 58 of the tooth 52 by the sensing element 44. Upon detection of this leading edge 58, the sensing element 44 supplies a first trigger signal to the controller 22. When this is the case, the rotor 18 is at a predetermined angle a from the top dead center of the piston 12. The controller 22 may thus determine when to energize the spark plug (not shown) associated with the piston 12 to keep the rotation of the rotor 18 in the forward direction (arrow 50) or to cause the direction of rotation to change.

Of course, when the rotor 18 rotates of an angle of 180 degrees in the direction of arrow 50, the sensing element 44 detects the leading edge 60 of the tooth 34.

In FIG. 3, the rotor 18 is positioned to illustrate detection of the leading edge 64 of the tooth 36 by the sensing element 46. Upon detection of this leading edge 64, the sensing element 46 supplies a second trigger signal to the controller 22. When this is the case, the rotor 18 is at a predetermined angle $\beta$ from the top dead center of the piston 12. The controller 22 may thus determine when to energize the spark plug (not shown) associated with the piston 12 to keep the rotation of the rotor 18 in the reverse direction (arrow 62) or to cause the direction of rotation to change.

Of course, when the rotor 18 rotates of an angle of 180 degrees in the direction of arrow 62, the sensing element 46 detects the leading edge 66 of the tooth 38.

It is to be noted that while the angles $\alpha$ and $\beta$ are illustrated herein as being equal, they could be different, as long as the controller 22 is configured to compensate for this angular difference.

Therefore, as will be easily understood by one skilled in the art, once the controller 22 determines, or decides, in which direction of rotation the rotor 18 with which the electronic ignition system of the present invention is associated rotates, it uses the appropriate trigger signal supplied by the sensor assembly 24, to time the ignition of the compressed gas in the piston's cylinders (not shown).

Of course, even though the electronic ignition system 10 has been described hereinabove mounted to a two-piston internal combustion engine, this system 10 could easily be designed to accommodate a different number of pistons.

As will be easily understood by one skilled in the art, the teeth 32–38 may be fastened to an outer casing of the rotor 18 or may be integrally formed with this outer casing defining the outer surface 20.

It is also to be noted that it is considered to be within the reach of one skilled in the art to design an electronic ignition system according to the present invention for four-stroke internal combustion engines.

Although the present invention has been described hereinabove by way of preferred embodiments thereof, it can be modified without departing from the spirit and nature of the subject invention as defined in the appended claims.

What is claimed is:

1. An electronic ignition system for an internal combustion engine including at least one cylinder in which a respective piston is slidably mounted for reciprocate movements between a top dead center and a bottom dead center; the piston being coupled to a rotor of the internal combustion engine; the rotor having a rotation axis and a generally cylindrical outer surface coaxial with the rotation axis; the outer surface of the rotor defining a rear cylindrical surface portion and a front cylindrical surface portion; the electronic ignition system comprising:

a controller;

for each piston, a first tooth mounted to a first predetermined position onto the rear cylindrical surface portion;

for each piston, a second tooth mounted to a second predetermined position onto said front cylindrical surface portion;

a sensor assembly including first and second sensing elements connected to said controller; said first sensing element facing the rear cylindrical surface portion of the rotor and supply a first trigger signal to said controller upon detection of said first projection; said second sensing element facing the front cylindrical surface portion of the rotor and supply a second trigger signal to said controller upon detection of said second projection;

wherein (a) said first predetermined position of said first tooth is such that said first sensing element supplies said first trigger signal to said controller before the piston reaches its top dead center when the rotor rotates about the rotation axis in a first direction; and (b) said second predetermined position of said second tooth is such that said second sensing element supplies said second trigger signal to said controller before the piston reaches its top dead center when the rotor rotates about the rotation axis in a second direction opposite to the first direction.

2. An electronic ignition system as recited in claim 1, wherein each said first and second teeth include a leading edge; said first and second sensing elements being configured to detect respective leading edges of said first and second teeth.

3. An electronic ignition system as recited in claim 1 wherein said first predetermined position of said first tooth is such that said first sensing element supplies said first trigger signal to said controller when the piston associated with said first tooth is at a predetermined position before its top dead center.

4. An electronic ignition system as recited in claim 1, wherein said second predetermined position of said second tooth is such that said second sensing element supplies said second trigger signal to said controller when the piston associated with said second tooth is at a predetermined position before its top dead center.

5. An electronic ignition system as recited in claim 1, wherein the rotor includes an external casing defining the outer surface of the rotor, said first and second teeth are an integral part of the external casing.

6. An electronic ignition system as recited in claim 1, wherein the internal combustion engine is a two-stroke internal combustion engine.

7. An electronic ignition system as recited in claim 1, wherein said first and second sensing elements are proximity sensing elements.

* * * * *